US010071011B2

(12) United States Patent
Denson et al.

(10) Patent No.: US 10,071,011 B2
(45) Date of Patent: Sep. 11, 2018

(54) COMPRESSION GARMENT INFLATION

(71) Applicant: KPR U.S., LLC, Mansfield, MA (US)

(72) Inventors: Jesse Denson, Lincoln, RI (US); Scott Wudyka, Marlboro, MA (US)

(73) Assignee: KPR U.S., LLC, Mansfield, MA (US)

( * ) Notice: Subject to any disclaimer, the term of this patent is extended or adjusted under 35 U.S.C. 154(b) by 790 days.

(21) Appl. No.: 14/318,734

(22) Filed: Jun. 30, 2014

(65) Prior Publication Data

US 2015/0374571 A1 Dec. 31, 2015

(51) Int. Cl.
*A61H 9/00* (2006.01)
*A61H 1/00* (2006.01)

(52) U.S. Cl.
CPC ..... *A61H 1/008* (2013.01); *A61H 9/0078* (2013.01); *A61H 2201/165* (2013.01); *A61H 2201/5002* (2013.01); *A61H 2201/5007* (2013.01); *A61H 2201/5071* (2013.01); *A61H 2205/10* (2013.01); *A61H 2209/00* (2013.01)

(58) Field of Classification Search
CPC ..... A61H 9/0078; A61H 2209/00; A61H 2201/5002; A61H 2201/5071; A61H 2201/165; A61H 2201/5007; A61H 9/005; A61H 9/0092
See application file for complete search history.

(56) References Cited

U.S. PATENT DOCUMENTS 3,878,839 A 4/1975 Norton et al.
4,186,732 A 2/1980 Christoffel
4,624,244 A 11/1986 Taheri
5,490,820 A 2/1996 Schock et al.
5,575,762 A 11/1996 Peeler et al.
5,827,209 A 10/1998 Gross
5,843,007 A 12/1998 McEwen et al.
5,951,502 A 9/1999 Peeler et al.
6,014,784 A 1/2000 Taylor et al.
6,051,016 A 4/2000 Mesaros et al.
6,231,532 B1 5/2001 Watson et al.
7,044,924 B1 5/2006 Roth et al.
7,935,066 B2 5/2011 Shives et al.
7,976,486 B2 7/2011 Raley et al.
(Continued)

FOREIGN PATENT DOCUMENTS

EP 2314268 A2 4/2011

OTHER PUBLICATIONS

International Search Report dated Sep. 14, 2015 in related application PCT/US2015/036558, 6 pages.
(Continued)

*Primary Examiner* — Timothy Stanis
(74) *Attorney, Agent, or Firm* — Nicole M. Creegan

(57) ABSTRACT

A test inflation cycle of fluid flow is controlled from a fluid source to each inflatable bladder of a plurality of inflatable bladders of a compression garment. Pressure signals from at least one pressure sensor are received and compared to one or more reference pressure values. One or more inflation parameters of at least one of the inflatable bladders is set based at least in part on the comparison of the pressure signals, and the inflatable bladders are inflated to a respective second pressure greater than the corresponding test inflation pressure of each bladder based at least in part on the set one or more inflation parameters.

20 Claims, 6 Drawing Sheets

(56) References Cited

U.S. PATENT DOCUMENTS

| | | | | |
|---|---|---|---|---|
| 8,235,922 | B2 | 8/2012 | Rowe et al. | |
| 8,449,483 | B2 | 5/2013 | Eddy | |
| 2003/0126912 | A1* | 7/2003 | Cook | A61H 9/0078 73/49.2 |
| 2005/0187500 | A1* | 8/2005 | Perry | A61H 9/0078 601/152 |
| 2006/0167389 | A1* | 7/2006 | Evans | A61H 23/04 601/152 |
| 2008/0262399 | A1* | 10/2008 | Kovelman | A61H 9/0078 601/152 |
| 2011/0224589 | A1 | 9/2011 | Bock | |
| 2012/0083712 | A1 | 4/2012 | Watson et al. | |
| 2014/0094725 | A1 | 4/2014 | Malhi et al. | |
| 2014/0094726 | A1* | 4/2014 | Malhi | A61H 9/00 601/152 |
| 2015/0150746 | A1* | 6/2015 | Yurko | A61H 1/008 601/150 |

OTHER PUBLICATIONS

Written Opinion of the International Searching Authority dated Sep. 14, 2015 in related application PCT/US2015/036558, 8 pages.

* cited by examiner

FIG. 5A

| Pressure Comparison | Inflation Parameter Action |
|---|---|
| $P_d > P_i$ | No Change |
| $P_i > P_p$ | No Change |
| $P_d > P_p$ | No Change |
| $P_i > P_d$ | Increase Inflation Time/Rate of Distal Bladder and/or Decrease Inflation Time/Rate of Intermediate Bladder |
| $P_p > P_i$ | Increase Inflation Time/Rate of Intermediate Bladder and/or Decrease Inflation Time/Rate of Proximal Bladder |
| $P_p > P_d$ | Increase Inflation Time/Rate of Distal Bladder and/or Decrease Inflation Time/Rate of Proximal Bladder |

FIG. 5B

| Pressure Comparison | Inflation Parameter Action |
|---|---|
| $P_d = P_{dp}$ | No Change |
| $P_i = P_{ip}$ | No Change |
| $P_i = P_{ip}$ | No Change |
| $P_d > P_{dp}$ | Decrease Inflation Time and/or Decrease Inflation Rate of Distal Bladder |
| $P_i > P_{ip}$ | Decrease Inflation Time and/or Decrease Inflation Rate of Intermediate Bladder |
| $P_p > P_{pp}$ | Decrease Inflation Time and/or Decrease Inflation Rate of Proximal Bladder |
| $P_d < P_{dp}$ | Increase Inflation Time and/or Increase Inflation Rate of Distal Bladder |
| $P_i < P_{ip}$ | Increase Inflation Time and/or Increase Inflation Rate of Intermediate Bladder |
| $P_p < P_{pp}$ | Increase Inflation Time and/or Increase Inflation Rate of Proximal Bladder |

COMPRESSION GARMENT INFLATION

BACKGROUND

Conventional vascular compression systems include a compression garment fluidly connected to a fluid source, for cyclically inflating the compression garment. The cyclical inflation of the compression garment enhances blood circulation and decreases the likelihood of deep vein thrombosis (DVT). A controller controls operation of the fluid source to deliver fluid to bladders of the compression garment to produce bladder pressure along the compression garment. The manner in which the compression garment is applied to the wearer's limb, the size and shape of the wearer's limb, and the wearer's activity during use of the compression garment can affect the gradient of the bladder pressure that is actually applied to the limb, potentially creating a disparity between a target gradient bladder pressure and the actual gradient bladder pressure applied to the limb.

SUMMARY

The present disclosure is directed to systems and methods of increasing the likelihood that a target therapeutic pressure gradient will, under a variety of conditions, be applied by a compression garment to a limb of a patient.

In general, in one aspect, a test inflation cycle of fluid flow is controlled from a fluid source to each inflatable bladder of a plurality of inflatable bladders of a compression garment. Pressure signals from at least one pressure sensor are received and compared to one or more reference pressure values. One or more inflation parameters of at least one of the inflatable bladders is set based at least in part on the comparison of the pressure signals, and the inflatable bladders are inflated to a respective second pressure greater than the corresponding test inflation pressure of each bladder based at least in part on the set one or more inflation parameters.

In some embodiments, comparing the received pressure signals to one or more reference pressure values includes comparing the received pressure signals to each other. Additionally or alternatively, comparing the received pressure signals to one or more reference pressure values can include comparing the received pressure signals to predetermined pressure values.

In certain embodiments, comparing the received pressure signals to one or more reference pressure values includes ranking the corresponding inflatable bladders relative to one another and setting the one or more inflation parameters includes adjusting the one or more inflation parameters based at least in part on the relative ranking of the inflatable bladders.

In some embodiments, the test inflation pressure of each bladder is less than about 20 mmHg and the second inflation pressure of each bladder is greater than about 25 mmHg.

In another aspect a compression device controller includes one or more processors and computer executable instructions embodied on a computer readable storage medium. The computer executable instructions include instructions for causing the one or more processors to control a test inflation cycle of fluid flow from a fluid source to each inflatable bladder of a plurality of inflatable bladders of a compression garment, receive a plurality of pressure signals from at least one pressure sensor, compare the received pressure signals to one or more reference pressure values, set one or more inflation parameters of at least one of the inflatable bladders, and inflate the inflatable bladders to a respective second pressure greater than the corresponding test inflation pressure of each bladder. Each pressure signal is indicative of a corresponding test inflation pressure in the respective inflatable bladder during the test inflation cycle. Setting the one or more inflation parameters of at least one of the inflatable bladders is based at least in part on the comparison of the pressure signals. Inflating the inflatable bladders to the respective second pressure is based at least in part on the set one or more inflation parameters.

In some embodiments, the instructions to receive pressure signals include instructions to rank the corresponding inflatable bladders relative to one another and the instructions to set one or more inflation parameters include instructions to adjust the one or more inflation parameters based at least in part on the relative ranking of the inflatable bladders. The instructions to set the one or more inflation parameters can include instructions to adjust the one or more inflation parameters if the relative ranking of the inflatable bladders does not match a set ranking of the inflatable bladders.

In certain embodiments, the instructions to set the one or more inflation parameters include instructions to set the one or more inflation parameters based on a predetermined pressure gradient of the respective second pressures of the inflatable bladders.

In some embodiments, the instructions to compare the received pressure signals to one or more reference pressure values include instructions to compare the received pressure signals to each other. Additionally or alternatively, the instructions to compare the received pressure signals to one or more reference pressure values can include instructions to compare the received pressure signals to predetermined pressure values.

In certain embodiments, the instructions to compare the received pressure signals to one or more reference pressure values includes instructions to compare an average of a plurality of pressure signals of a respective inflatable bladder to one or more reference pressure values.

In some embodiments, the test inflation pressure of each bladder is less than about 20 mmHg and the second inflation pressure of each bladder is greater than about 25 mmHg.

In certain embodiments, the instructions to control the test inflation cycle of fluid flow to each inflatable bladder includes instructions to control one or more of a test inflation time and a test inflation flow rate to each respective bladder.

In some embodiments, the instructions to control the test inflation cycle of fluid flow to each inflatable bladder include instructions to initiate the test inflation bladder at a regular interval. Additionally or alternatively, the computer readable storage medium can further include instructions for causing the one or more processors determine a vascular refill time associated with a limb of a subject, and the instructions to control the test inflation cycle of fluid flow to each inflatable bladder are initiated based at least in part on a change in the vascular refill time associated with the limb of the subject.

In certain embodiments, the instructions to control the test inflation cycle of fluid flow to each inflatable bladder include instructions to inflate and deflate one inflatable bladder at a time. Additionally or alternatively, the instructions to control the test inflation cycle of fluid flow to each inflatable bladder can include instructions to inflate and deflate each inflatable bladder in sequence, one after another.

In some embodiments, each pressure signal is received generally at an end of the test inflation cycle of the respective inflatable bladder.

In yet another aspect, a compression system includes a compression garment including inflatable bladders, valves, at least one pressure sensor, and a controller in electrical communication with the at least one pressure sensor and the valves. The valves are actuatable to control fluid flow from a fluid source to the inflatable bladders, and the at least one pressure sensor is positionable, through actuation of the valves, in pneumatic communication with each inflatable bladder. The controller includes one or more processors, a computer readable storage medium, and computer executable instructions embodied on the computer readable storage medium. The computer executable instructions include instructions for causing the one or more processors to control a test inflation cycle of fluid flow from a fluid source to each inflatable bladder, receive a plurality of pressure signals from at least one pressure sensor, compare the received pressure signals to one or more reference pressure values, set one or more inflation parameters of at least one of the inflatable bladders, and inflate the inflatable bladders to a respective second pressure greater than the corresponding test pressure of each bladder. Each pressure signal is indicative of the corresponding test inflation pressure in the respective inflatable bladder. Setting the one or more inflation parameters of at least one of the inflatable bladders is based at least in part on the comparison of the pressure signals, and inflating the inflatable bladders to a respective second pressure is based at least in part on the set one or more inflation parameters.

In another aspect, a system includes means for controlling a test inflation cycle of fluid flow from a fluid source to each inflatable bladder of a plurality of inflatable bladders, means for receiving a plurality of pressure signals from at least one pressure sensor, means for comparing the received pressure signals to one or more reference pressure values, means for setting one or more inflation parameters of at least one of the inflatable bladders, and means for inflating the inflatable bladders to a respective second pressure greater than the corresponding test pressure of each bladder. Each pressure signal is indicative of the corresponding test inflation pressure in the respective inflatable bladder. The setting is based at least in part on the comparison of the pressure signals, and the inflating of the inflatable bladders to the respective second pressure is based at least in part on the set one or more inflation parameters.

In certain embodiments, the system further includes means for determining a vascular refill time associated with a limb of a subject, and the means for controlling the test inflation cycle of fluid flow to each inflatable bladder is responsive to a change in the vascular refill time associated with the limb of the subject.

Embodiments can include one or more of the following advantages.

In some embodiments, one or more inflation parameters of at least one of the inflatable bladders is set based at least in part on the comparison of the pressure signals indicative of the corresponding test inflation pressure in the respective inflatable bladders during the test inflation cycle. As compared to compression systems operating on the assumption that the internal volume of an inflatable bladder remains unchanged after application of a compression garment to a wearer's limb, the setting of one or more inflation parameters based at least in part on the comparison of test inflation pressures can increase the likelihood that, under a variety of conditions, an appropriate pressure gradient will be applied to the limb of the wearer during a therapeutic compression cycle. Additionally or alternatively, as compared to compression systems that assume an unchanged internal volume of inflatable bladders, the use of the test inflation pressure to set the one or more inflation parameters of one or more inflatable bladders for subsequent inflation to the second, greater pressure can facilitate control over the upper limit of therapeutic compression pressure applied to the limb of the wearer.

In certain embodiments, controlling the test inflation cycle of fluid flow to each inflatable bladder includes to initiate the test inflation cycle to each bladder at a regular interval. As compared to compression systems operating on the assumption that the internal volume of an inflatable bladder remains unchanged after application of a compression garment to a wearer's limb, initiating the test inflation cycle to each bladder at a regular interval can reduce the likelihood that a therapeutic compression gradient applied to a wearer's limb will shift over time.

In some embodiments, controlling the test inflation cycle of fluid flow to each inflatable bladder is initiated based at least in part on a change in a condition (e.g., vascular refill time) associated with the limb of a wearer. As compared to compression systems operating on the assumption that the internal volume of an inflatable bladder remains unchanged after application of a compression garment to a wearer's limb, initiating the test inflation cycle to each bladder based on a change in a measured condition will facilitate adjusting inflation parameters shortly after a change in the condition occurs such that the time associated. Such responsive initiation of the test inflation cycle can result in more efficient application of therapeutic compression to the limb of a wearer by increasing the amount of time that an appropriate therapeutic compression gradient is applied to the limb of the wearer.

Other aspects, features, and advantages will be apparent from the description and drawings, and from the claims.

BRIEF DESCRIPTION OF THE DRAWINGS

FIGS. 5A-5B are tables identifying the inflation parameter action associated with a pressure comparison during the test inflation cycle.

Corresponding reference characters indicate corresponding parts throughout the drawings.

DETAILED DESCRIPTION

As used herein, the terms "proximal" and "distal" represent relative locations of components, parts and the like of a compression garment when the garment is worn. For example, a "proximal" component is disposed most adjacent to the wearer's torso, a "distal" component is disposed most distant from the wearer's torso, and an "intermediate" component is disposed generally anywhere between the proximal and distal components.

Figure 1:
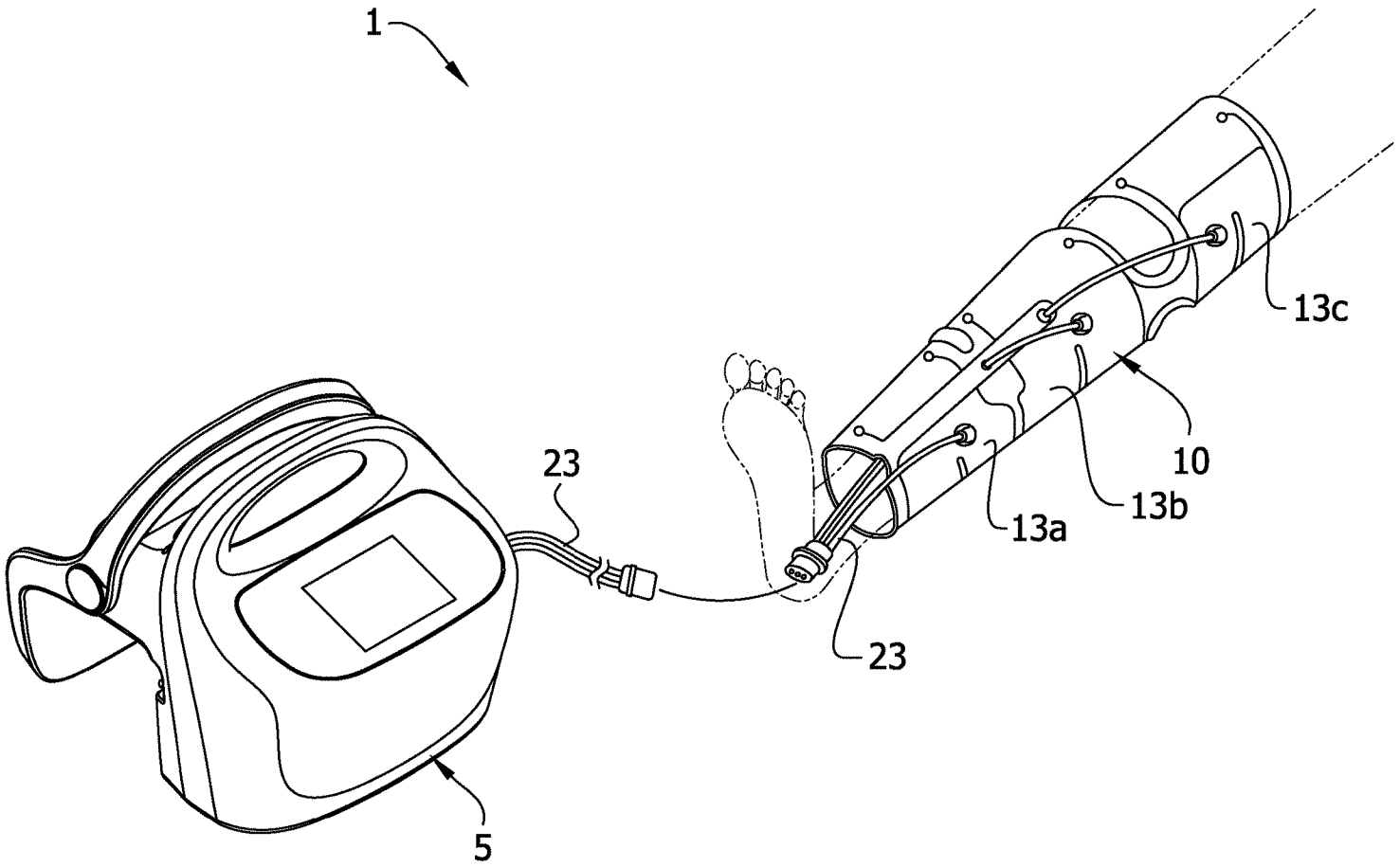
FIG. 1 is a perspective of a compression system including a compression garment and a controller.
Figure 2:
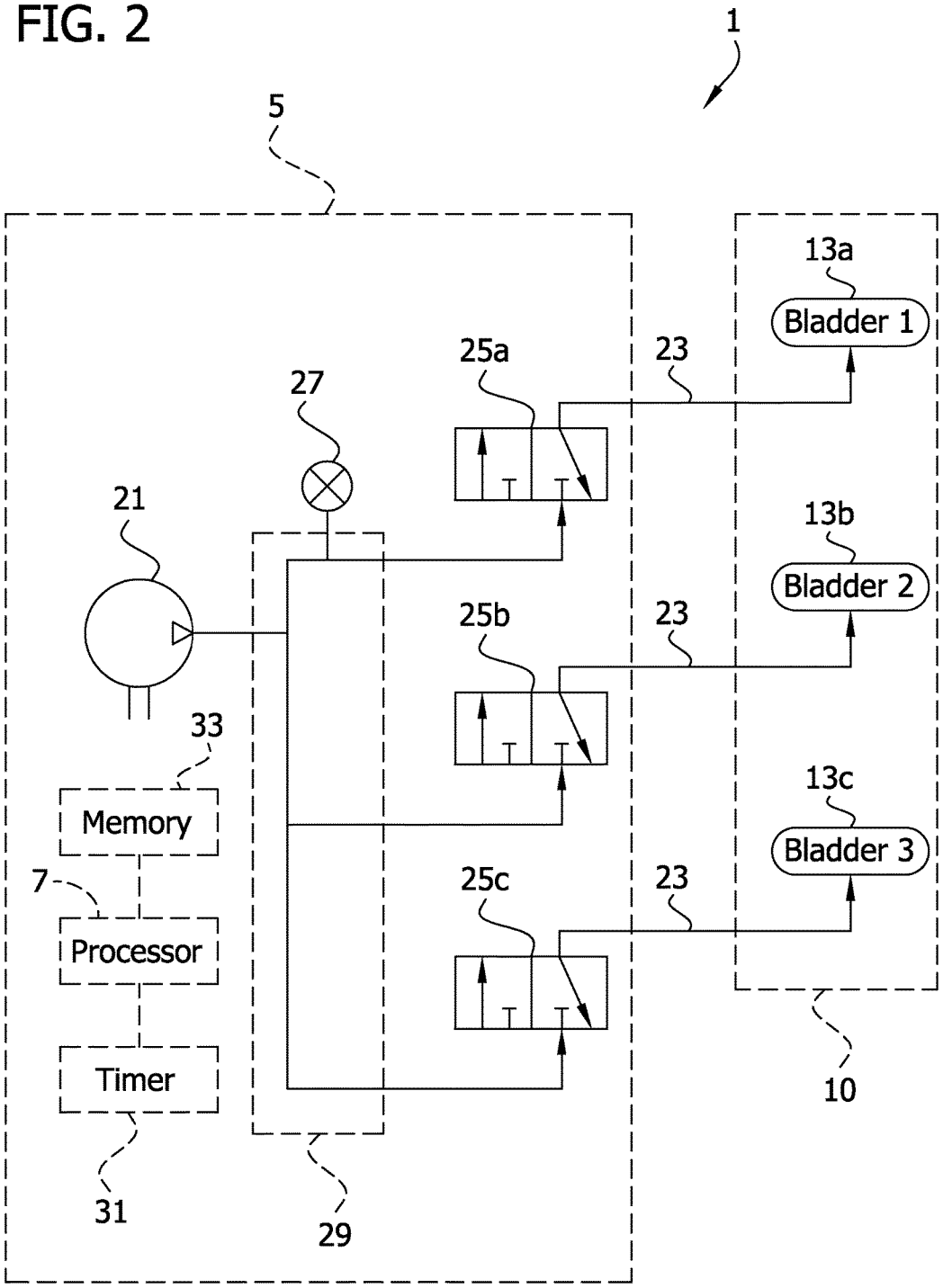
FIG. 2 is a schematic of the compression system of FIG. 1, including a schematic of a pneumatic circuit.

Referring to FIGS. 1 and 2, a compression system 1 includes a compression garment 10 for applying sequential compression therapy to a limb of a wearer and a controller 5 having one or more processors 7 and computer executable instructions embodied on a computer readable storage medium 33, the computer executable instructions including instructions for causing the one or more processors to control operation of the compression garment 10. The compression garment 10 includes a distal inflatable bladder 13*a*, an intermediate inflatable bladder 13*b*, and a proximal inflatable bladder 13*c*. The compression garment 10 can be of a substantially one-size-fits-all configuration with respect to the circumferences of different wearers' legs (e.g., with an inner surface and an outer surface of the compression garment 10 secured to one another through the use of hook and loop fasteners).

As described in further detail below, the controller 5 controls operation of the compression garment 10 to perform a test inflation cycle, in which the inflatable bladders 13*a*, 13*b*, 13*c* are inflated to a non-therapeutic pressure (e.g., less than about 20 mmHg) to verify and, if necessary, adjust the gradient pressure applied to the wearer's limb by the inflatable bladders 13*a*, 13*b*, 13*c* of the compression garment 10 during one or more subsequent therapeutic compression cycles. As compared to compression systems that do not adjust gradient pressure, the adjustment of the gradient pressure based on a test inflation cycle of the inflatable bladders 13*a*, 13*b*, 13*c* can, for example, increase the likelihood that an appropriate compression gradient is applied to a limb of a wearer during therapeutic compression cycles through variations associated with the position of the wearer's limb and/or fit of the compression garment 10.

The compression garment 10 is a thigh-length sleeve positionable around the leg of the wearer, with the distal bladder 13*a* around the wearer's ankle, the intermediate bladder 13*b* around the wearer's calf, and the proximal bladder 13*c* around the wearer's thigh. The inflatable bladders 13*a*, 13*b*, 13*c* expand and contract under the influence of air pressure or other fluids delivered from a pressurized fluid source 21 in electrical communication with the controller 5. The pressurized fluid source 21 delivers pressurized fluid (e.g., air) to the inflatable bladders 13*a*, 13*b*, 13*c* through tubing 23.

Referring to FIG. 2, each inflatable bladder 13*a*, 13*b*, 13*c* is in fluid communication with a respective valve 25*a*, 25*b*, 25*c*. A pressure sensor 27 is in communication (e.g., fluid communication and/or mechanical communication) with the manifold 29 to measure pressure in the manifold 29. Fluid communication between the manifold 29 and the respective inflatable bladders 13*a*, 13*b*, 13*c* can be controlled through control of the position of the respective valves 25*a*, 25*b*, 25*c* (e.g., through activation and/or deactivation of the respective valves 25*a*, 25*b*, 25*c*). The pressure sensor 27 is in electrical communication with the controller 5 to deliver to the controller 5 signals indicative of the measured pressure of the manifold 29 and/or one or more of the inflatable bladders 13*a*, 13*b*, 13*c* in fluid communication with the manifold 29 as a result of the positions of the respective valves 25*a*, 25*b*, 25*c*. For example, the pressure sensor 27 measures pressure in the combined volume of the manifold 29 and the inflatable bladder 13*a* when valve 25*a* is open and valves 25*b*, 25*c* are closed. The volume of the manifold 29 is fixed. Accordingly, for a given volume of air, changes in pressure measured by the pressure sensor 27 for a given inflatable bladder 13*a*, 13*b*, 13*c* reflects a change in volume of the respective inflatable bladder 13*a*, 13*b*, 13*c*.

Each valve 25*a*, 25*b*, 25*c* is a 3-way/2-position, normally closed, solenoid valve. Each of these valves includes three ports and is actuatable to place a first port (an inlet port) in fluid communication with a second port (a bladder port) in a first position. Each valve is further actuatable to place the second port in fluid communication with a third port (vent port) in a second position. The first port of each valve 25*a*, 25*b*, 25*c* is in fluid communication with the pressurized fluid source 21 and the manifold 29. The second port of each valve 25*a*, 25*b*, 25*c* is in fluid communication with a respective inflatable bladder 13*a*, 13*b*, 13*c*, and the third port is in fluid communication with ambient atmosphere. It should be appreciated that the valves 25*a*, 25*b*, 25*c* could be other types and have other arrangements within the compression system 1 without departing from the scope of the present disclosure.

Figure 4:
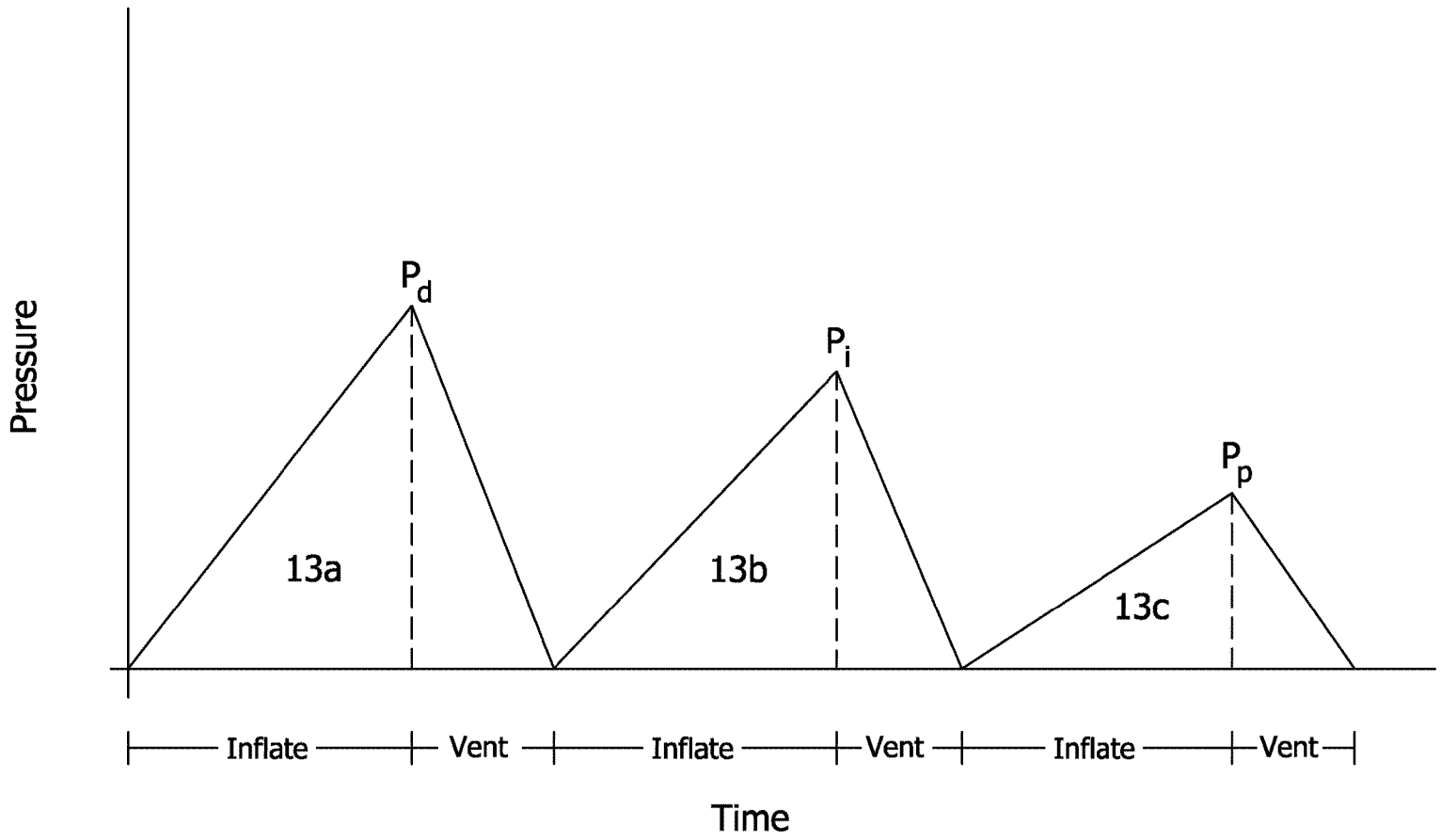
FIG. 4 is a graphical illustration of a pressure profile produced by the compression system of FIG. 1 during the non-therapeutic test inflation cycle.

Referring now to FIGS. 2 and 4, the computer executable instructions embodied on the computer readable storage medium 33 cause the one or more processors 7 to pressurize (e.g., inflate) the inflatable bladders 13*a*, 13*b*, 13*c* to provide cyclical therapeutic compression pressure to a wearer's limb. For example, in a phase of the therapeutic compression cycle known as the inflation phase, the computer executable instructions embodied on the computer readable storage medium 33 cause the one or more processors 7 to control the pressurized fluid source 21 and/or the valves 25*a*, 25*b*, 25*c* to pressurize the inflatable bladders 13*a*, 13*b*, 13*c* to therapeutic compression pressures (e.g., about 25 mmHg and above) for a predetermined amount of time to move the blood in the limb from regions underlying the inflatable bladders 13*a*, 13*b*, 13*c*. Following the inflation phase, in a phase of the therapeutic compression cycle known as the vent phase, the computer executable instructions may cause the one or more processors 7 to control the pressurized fluid source 21 and/or the valves 25*a*, 25*b*, 25*c* to reduce the pressure in the inflatable bladders 13*a*, 13*b*, 13*c* to atmospheric pressure.

Additionally or alternatively, the computer executable instructions may cause the one or more processors 7 to control the pressurized fluid source 21 and/or the valves 25*a*, 25*b*, 25*c* to reduce the pressure in the inflatable bladders 13*a*, 13*b*, 13*c* to a residual pressure (e.g., about 6 mmHg to about 8 mmHg). With the inflatable bladders 13*a*, 13*b*, 13*c* inflated to the residual pressure, blood can reenter the regions of the limb underlying the inflatable bladders 13*a*, 13*b*, 13*c*. The pressure in the inflatable bladders 13*a*, 13*b*, 13*c* can be sensed by the pressure sensor 27 until it is determined that blood flow has been completely restored to the regions of the limb underlying the inflatable bladders 13*a*, 13*b*, 13*c*. The time elapsed from the onset of the vent phase until blood flow is restored is measured by a timer 31 of the controller 5 and stored in the computer readable storage medium 33. This time associated with restoration of blood flow in regions of the limb underlying the inflatable bladders 13*a*, 13*b*, 13*c* is known as the venous refill time. The interval between successive initiations of the therapeutic compression cycle can be adjusted based on the venous refill time associated with the wearer of the compression garment 10.

In some embodiments, the pressure gradient during the inflation phase of the therapeutic compression cycle decreases from the distal inflatable bladder 13*a* to the proximal inflatable bladder 13*c*. For example, the distal inflatable bladder 13*a* can be inflated to about 45 mmHg, the intermediate inflatable bladder 13*b* can be inflated to about 40 mmHg, and the proximal inflatable bladder 13*c* can be inflated to about 30 mmHg during the inflation phase of the therapeutic compression cycle. It should be appreciated that the operation of the controller 5 to perform a test inflation cycle to adjust the compression gradient of the inflatable bladders 13*a*, 13*b*, 13*c* can facilitate maintaining this compression gradient through variations associated with the position of the wearer's limb and/or fit of the compression garment 10. For example, the operation of the controller 5 to perform a test inflation cycle to adjust the compression gradient of the inflatable bladders 13*a*, 13*b*, 13*c* can reduce the likelihood of the occurrence of a reverse gradient condition (a condition in which the pressure gradient increases from the distal inflatable bladder 13*a* to the proximal inflatable bladder 13*c*), which works against the desired therapeutic effect of the compression garment 10.

Figure 3:
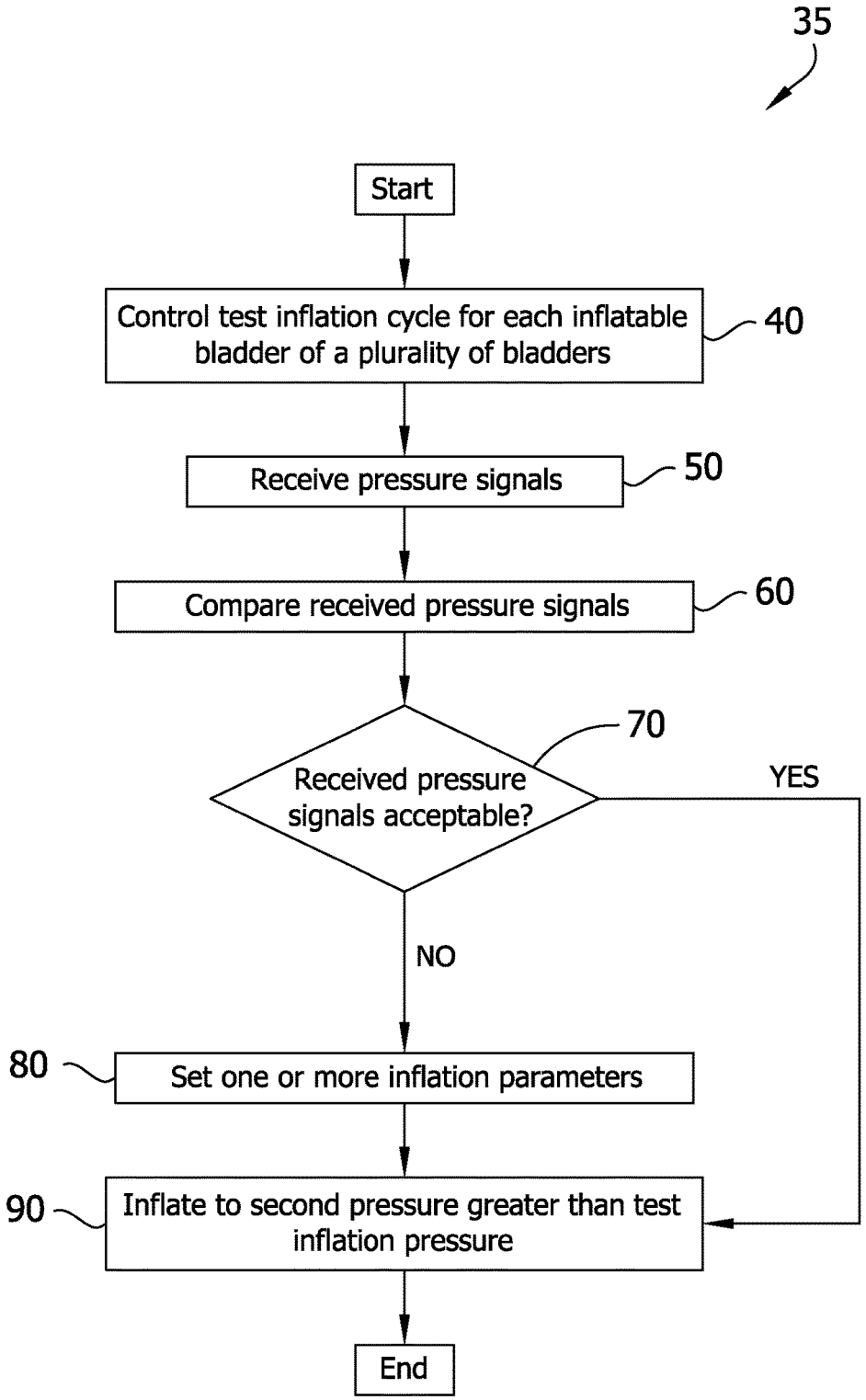
FIG. 3 is a flow chart of a non-therapeutic test inflation cycle performed by the compression system of FIG. 1.

FIG. 3 schematically depicts an example of a method 35 of controlling inflation of a compression garment to perform a test inflation cycle to set one or more therapeutic inflation parameters (e.g., time of inflation and/or rate of inflation) of at least one of the inflatable bladders of the compression garment. For ease of description, the method 35 of controlling inflation of a compression garment is described with respect to the compression system 1 shown in FIGS. 1 and 2. It should be appreciated, however, that the method 35 can be implemented using any of various different hardware and software configurations without departing from the scope of the present disclosure.

Referring now to FIGS. 1-5A, the computer executable instructions embodied on the computer readable storage medium 33 cause the one or more processors 7 to execute the method 35 of controlling inflation of the compression garment 10. In an exemplary embodiment described in further detail below, the computer executable instructions embodied on the computer readable storage medium 33 cause the one or more processors 7 to control 40 a test inflation cycle in each of the inflatable bladders 13*a*, 13*b*, 13*c*, receive 50 from the pressure sensor 27 a plurality of pressure signals indicative of a corresponding test inflation pressure in the inflatable bladders 13*a*, 13*b*, 13*c*, compare 60 the received pressure signals to one or more reference values, set 80 one or more inflation parameters based at least in part on the comparison 60, and inflate 90 the inflatable bladders 13*a*, 13*b*, 13*c*, based on the one or more set 80 inflation parameters, to a second pressure greater than the corresponding test inflation pressure of each inflatable bladder 13*a*, 13*b*, 13*c*.

The control 40 of the test inflation cycle in each of the inflatable bladders 13*a*, 13*b*, 13*c* includes controlling fluid flow from the pressurized fluid source 21 to each of the inflatable bladders 13*a*, 13*b*, 13*c*. For example, the one or more processors 7 can execute instructions to open one of the valves 25*a*, 25*b*, 25*c* for a set amount of time using the timer 31 electrically connected to the one or more processors 7, and deliver pressurized fluid to one of the inflatable bladders 13*a*, 13*b*, 13*c* via the pressurized fluid source 21 at a set rate to inflate the inflatable bladder for the test inflation cycle. The set amount of time each valve 25*a*, 25*b*, 25*c* is open and the rate the pump 21 delivers pressurized fluid to the respective bladders 13*a*, 13*b*, 13*c* is such that a test inflation pressure in each inflatable bladder will be less than about 20 mmHg and greater than about 5 mmHg. An inflatable bladder pressure of less than about 20 mmHg is considered to be a non-therapeutic inflation pressure because pressures of this amount are generally understood as unsuitable for moving a therapeutically effective amount of blood in a wearer's limb. An inflatable bladder pressure of greater than about 5 mmHg is generally understood to be suitable for accurate control and measurement.

The control 40 of the test inflation cycle can additionally or alternatively include operating a corresponding valve (e.g., valve 25*a*) to position the pressure sensor 27 to measure a pressure in one inflatable bladder (e.g., distal inflatable bladder 13*a*) via the manifold 29 at or immediately after a set amount of time has expired and while the valve 25*a* is still open. The pressure sensor 27 provides a pressure signal $P_d$ indicative of the measured test inflation pressure of the inflatable bladder 13*a* and for use by the controller 5. After pressurizing the bladder 13*a* to the test inflation pressure, the one or more processors 7 may execute instructions to vent the inflatable bladder 13*a* to reduce the pressure in the inflatable bladder 13*a* to atmospheric pressure or to a residual pressure (e.g., less than about 20 mmHg). The one or more processors 7 execute analogous instructions related to the inflatable bladders 13*b*, 13*c*. Accordingly, the pressure sensor 27 also provides a pressure signal $P_i$ indicative of the measured test inflation pressure of the inflatable bladder 13*b* and a pressure signal $P_p$ indicative of the measured test inflation pressure of the inflatable bladder 13*c*.

The test inflation cycle can be performed separately for each of the inflatable bladders 13*a*, 13*b*, 13*c* to measure the respective pressure signal $P_d$, $P_i$, $P_p$ for each of the inflatable bladders 13*a*, 13*b*, 13*c*. For example, the one or more processors 7 can execute instructions such that the test inflation cycle of each of the inflatable bladders 13*a*, 13*b*, 13*c* do not overlap. The separate test inflation cycle of the inflatable bladders 13*a*, 13*b*, 13*c* can facilitate, for example, monitoring and identifying anomalies associated with each individual bladder 13*a*, 13*b*, 13*c*.

In certain embodiments, the control 40 of the test inflation cycle in the inflatable bladders 13*a*, 13*b*, 13*c* includes inflating and deflating each of the inflatable bladders 13*a*, 13*b*, 13*c* in sequence, one after another, without an intervening therapeutic compression cycle. Such sequential test cycles of the inflatable bladders 13*a*, 13*b*, 13*c*, without an intervening therapeutic compression cycle, can improve the accuracy of the comparison of the inflatable bladders 13*a*, 13*b*, 13*c* by, for example, reducing the likelihood that a condition (e.g., position) of the compression garment 10 has shifted in the time between the test cycles of the inflatable bladders 13*a*, 13*b*, 13*c*. In some embodiments, the control 40 of the test inflation cycle in each of the inflatable bladders 13*a*, 13*b*, 13*c* includes controlling a test cycle of one of the inflatable bladders 13*a*, 13*b*, 13*c* following a first therapeutic compression cycle, controlling a test cycle of another of the inflatable bladders 13*a*, 13*b*, 13*c* following a second therapeutic compression cycle, and controlling a test cycle of a final one of the inflatable bladders 13*a*, 13*b*, 13*c* following a third therapeutic compression cycle. No analysis of the received pressure signals $P_d$, $P_i$, $P_p$ is done until a test inflation cycle has been performed on each inflatable bladder 13*a*, 13*b*, 13*c*, after multiple therapeutic compression cycles have taken place, so that data for all three bladders 13*a*, 13*b*, 13*c* is acquired. Such stratification of the test inflation cycles of the inflatable bladders 13*a*, 13*b*, 13*c* can, for example, reduce the contiguous amount of time a wearer of the compression garment 10 is without therapeutic compression treatment.

The control 40 of the test inflation cycle for each inflatable bladder 13*a*, 13*b*, 13*c* can be initiated at a regular interval. For example, the control 40 of the test inflation cycle for a first of the inflatable bladder 13*a*, 13*b*, 13*c* can be initiated following completion of a first therapeutic cycle after a fixed interval (e.g., 30 minutes) has elapsed. Additionally or alternatively, the control 40 of the test inflation cycle for a first inflatable bladder 13*a*, 13*b*, 13*c* can be initiated following completion of a first therapeutic cycle after a user-specified (e.g., specified by a clinician through input into the controller 5) regular interval has elapsed. Initiation of the test inflation cycle at a regular interval (e.g., a fixed interval or a user-specified interval) can, for example, facilitate routine monitoring of the gradient pressure profile across the compression garment 10. In some embodiments, the control 40 of the test inflation cycle for each inflatable bladder 13*a*, 13*b*, 13*c* is initiated upon initial connection of the compression garment 10 to the controller 5. Such an initial test inflation cycle can, for example, facilitate checking the connection between the compression garment 10 and the controller 5 and/or checking placement of the compression garment 10 on the limb of the wearer.

The receipt 50, from the pressure sensor 27, of the plurality of pressure signals $P_d$, $P_i$, $P_p$ indicative of a corresponding test inflation pressure in the inflatable bladders 13*a*, 13*b*, 13*c* includes receiving the plurality of pressure signals $P_d$, $P_i$, $P_p$ during the test inflation cycle of each respective inflatable bladder 13*a*, 13*b*, 13*c* and storing the plurality of pressure signals $P_d$, $P_i$, $P_p$ on the computer readable storage medium 33. The received 50 pressure signals $P_d$, $P_i$, $P_p$ can be received generally at an end of the test inflation cycle of the respective inflatable bladder 13*a*, 13*b*, 13*c*. The receipt 50 of pressure signals $P_d$, $P_i$, $P_p$ generally at an end of the test inflation cycle can, for example, increase the likelihood that the pressure signal $P_d$, $P_i$, $P_p$ is indicative of a stabilized condition in the respective inflatable bladder 13*a*, 13*b*, 13*c*.

The pressure profile in FIG. 4 represents an ideal test inflation pressure profile recorded during a test inflation cycle where, in the example shown, the pressure signal $P_d$ in the distal inflatable bladder 13*a* is higher than the pressure signal $P_i$ in the intermediate inflatable bladder 13*b*, and the pressure signal $P_i$ in the intermediate inflatable bladder 13*b* is higher than the pressure signal $P_p$ in the proximal inflatable bladder 13*c*. It should be appreciated that, in this example, the pressure signals $P_d$, $P_i$, $P_p$ reflect a pressure gradient in the compression garment 10. Other types of test inflation pressure profiles during a test cycle (e.g., a profile in which the pressure signals $P_d$, $P_i$, $P_p$ are substantially the same (e.g., within 2% of one another)) are within the scope of the present disclosure. In some embodiments, a graphical representation of $P_d$, $P_i$, $P_p$ is displayed by the controller 5.

The received 50 pressure signals $P_d$, $P_i$, $P_p$ are compared 60 to one or more reference pressure values. In some embodiments, comparing 60 the received pressure signals $P_d$, $P_i$, $P_p$ includes comparing the received pressure signals $P_d$, $P_i$, $P_p$ to one another. For example, the one or more processors 7 can rank the received pressure signals $P_d$, $P_i$, $P_p$ by determining if $P_d$ is less than or greater than $P_i$, determining if $P_i$ is less than or greater than $P_p$, and determining if $P_p$ is less than or greater than $P_d$. In addition or as an alternative to the comparison 60 including a ranking, embodiments based on comparing 60 the received pressure signals $P_d$, $P_i$, $P_p$ to one another can include determining whether the values of the received pressure signals $P_d$, $P_i$, $P_p$ differ from one another by more than a predetermined amount. For example, the comparison 60 can be based on whether the pressure signals $P_d$, $P_i$, $P_p$ differ from one another by a predetermined percentage. Additionally or alternatively, the comparison 60 can be based on whether one or more of the pressure signals $P_d$, $P_i$, $P_p$ differ from one another by a predetermined absolute amount (e.g., specified in mmHg).

The computer readable storage medium 33 includes computer executable instructions to cause the one or more processors 7 to determine 70 if the comparisons show that the received pressure signals $P_d$, $P_i$, $P_p$ are acceptable. For example, if the determination 70 is made that the comparison 60 shows the received pressure signals $P_d$, $P_i$, $P_p$ match a set ranking (e.g., $P_d>P_1>P_p$, as is the case in the example shown in FIG. 4) then the inflatable bladders 13*a*, 13*b*, 13*c* have the proper ranking to produce a desired pressure gradient, no adjustments are made, and each inflatable bladder 13*a*, 13*b*, 13*c* is inflated 90 to a second pressure (e.g., a therapeutic compression pressure of greater than about 25 mmHg) greater than the test inflation pressure to impart therapeutic treatment to a limb of a wearer.

If, however, the determination 70 is made that the comparison 60 shows the received pressure signals $P_d$, $P_i$, $P_p$ are not acceptable (e.g., do not match a set ranking), one or more inflation parameters of one or more of the inflatable bladders 13*a*, 13*b*, 13*c* is/are set 80 based on the comparison of the received pressure signals $P_d$, $P_i$, $P_p$. As described herein, the one or more inflation parameters include parameters associated with the valves 25*a*, 25*b*, 25*c* and/or one or more parameters associated with the pressurized fluid source 21. Thus, for example, setting 80 the one or more inflation parameters of the one or more inflatable bladders 13*a*, 13*b*, 13*c* can include adjusting the open time of one or more of the valves 25*a*, 25*b*, 25*c* and/or to adjust the flow rate of fluid from the pressurized fluid source 21 (e.g., by adjusting a pump speed of a variable speed pump) for a given bladder 13*a*, 13*b*, 13*c* for the therapeutic compression cycle subsequent to the test inflation cycle.

An example of setting 80 the one or more inflation parameters of the inflatable bladders 13*a*, 13*b*, 13*c* is shown in FIG. 5A. In general, the received pressure signals $P_d$, $P_i$, $P_p$ corresponding to the test inflation pressures in the respective inflatable bladders during the test inflation cycle serve as proxies for the actual pressures in the inflatable bladders 13*a*, 13*b*, 13*c* during the therapeutic compression cycle. Accordingly, as described in further detail below, the received pressure signals $P_d$, $P_i$, $P_p$ corresponding to the test inflation pressures serve as the basis for setting one or more inflation parameters of at least one of the inflatable bladders 13*a*, 13*b*, 13*c* to achieve an appropriate compression gradient in the compression garment 10 during therapeutic compression cycles following the test inflation cycle.

If the received pressure signal $P_i$ for the intermediate inflatable bladder 13*b* is higher than the received pressure signal $P_d$ for the distal inflatable bladder 13*a*, the one or more processors 7 can execute instructions to control the valves 25*a*, 25*b*, 25*c* (e.g., by changing one or more valve positions) and/or the pressurized fluid source 21 (e.g., by controlling a speed of a variable speed pump) to increase the inflation time for the distal inflatable bladder 13*a*, decrease the inflation time for the intermediate inflatable bladder 13*b*, increase the rate of inflation for the distal inflatable bladder 13*a*, and/or decrease the rate of inflation for the intermediate inflatable bladder 13*b* during a subsequent therapeutic compression cycle to achieve a pressure gradient in which $P_d>P_i>P_p$.

If the received pressure signal $P_p$ for the proximal inflatable bladder 13*c* is higher than the received pressure signal $P_i$ for the intermediate inflatable bladder 13*b*, the one or more processors 7 can execute instructions to control the valves 25*a*, 25*b*, 25*c* and/or the pressurized fluid source 21 to increase the inflation time for the intermediate inflatable bladder 13*b*, decrease the inflation time for the proximal inflatable bladder 13*c*, increase the rate of inflation for the intermediate inflatable bladder 13*b*, and/or decrease the rate of inflation for the proximal inflatable bladder 13*c* during a subsequent therapeutic compression cycle to achieve a pressure gradient in which $P_d>P_i>P_p$.

If the received pressure signal $P_p$ for the proximal inflatable bladder 13*c* is higher than the received pressure signal $P_d$ for the distal inflatable bladder 13*a*, the one or more processors 7 can execute instructions to control the valves 25*a*, 25*b*, 25*c* and/or the pressurized fluid source 21 to increase the inflation time for the distal inflatable bladder 13*a*, decrease the inflation time for the proximal inflatable bladder 13*c*, increase the rate of inflation for the distal inflatable bladder 13*a*, and/or decrease the rate of inflation for the proximal inflatable bladder 13*c* during a subsequent therapeutic compression cycle to achieve a pressure gradient in which $P_d>P_i>P_p$.

Based at least in part on the set 80 one or more inflation parameters, the inflatable bladders 13*a*, 13*b*, 13*c* are each inflated 90 to a second pressure greater than the corresponding test inflation pressure of each inflatable bladder 13*a*, 13*b*, 13*c*. The second pressure of each inflatable bladder 13*a*, 13*b*, 13*c* can, for example, be a therapeutic compression pressure greater than about 22 mmHg. With the one or more inflation parameters set 80, the inflation 90 of the inflatable bladders 13*a*, 13*b*, 13*c* to the second pressure greater than the corresponding test inflation pressure can result in appropriate pressure gradient applied by the compression garment 10 to the limb of the wearer.

While certain embodiments have been described, other embodiments are additionally or alternatively possible.

For example, while controlling 40 the test inflation cycle of fluid flow from the pressurized fluid source to each inflatable bladder 13*a*, 13*b*, 13*c* has been described as being initiated at a regular interval, other intervals for initiating control 40 of the test inflation cycle are additionally or alternatively possible. For example, initiation of the control 40 of the test inflation cycle can occur more frequently following a change in the one or more inflation parameters of the one or more inflatable bladders 13*a*, 13*b*, 13*c*. A change in the one or more inflation parameters can indicate a change in the position of the limb and/or a change in the position of the garment 10 with respect to the limb. Thus, a change in the one or more inflation parameters of the inflatable bladders 13*a*, 13*b*, 13*c* can be indicative of a transient condition through which the pressure gradient of the compression garment 10 should be more closely monitored. The interval between initiating control 40 of the test inflation cycle can be gradually increased with each determination 70 that the one or more inflation parameters of the inflatable bladders 13*a*, 13*b*, 13*c* should remain unchanged.

Additionally or alternatively, controlling 40 the test inflation cycle can be initiated in response to a change in a measured vascular refill time associated with the compression garment 10. Changes in vascular refill time can indicate a change in the position of the garment and/or in the wearer's physiology. Thus, a change in vascular refill time can serve as a useful trigger to initiate control 40 of the test inflation cycle. Additionally or alternatively, controlling 40 the test inflation cycle can be initiated in response to patient activity. For example, sensors can detect movement of the compression garment 10 initiate control 40 of the test inflation cycle upon sensing a threshold level of movement. Among other things, movement of the compression garment 10 can cause the effective volume of one or more of the inflatable bladders 13*a*, 13*b*, 13*c* to change, possibly causing a deviation from a desired pressure gradient to be applied across the compression garment 10. Thus, checking the pressure gradient upon detecting a threshold level of movement of the compression garment 10 can facilitate timely recalibration of the compression gradient of the compression garment 10 in response to a change in conditions. As another example, while comparing 60 the received pressure signals to one or more reference pressure values has been described as including comparing 60 the received pressure signals $P_d$, $P_i$, $P_p$ to one another, other standards of comparison are additionally or alternatively within the scope of the present disclosure.

For example, referring now to FIGS. 1-4 and 5B, the received pressure signals $P_d$, $P_i$, $P_p$ can be compared 60 to predetermined test inflation pressures $P_{dp}$, $P_{ip}$, $P_{pp}$ stored in the computer readable storage medium 33 and indicative of a desired pressure in the respective inflatable bladders 13*a*, 13*b*, 13*c* during the test inflation cycle. The predetermined test inflation pressure $P_{dp}$ in the distal inflatable bladder 13*a* can be greater than a predetermined test inflation pressure $P_{ip}$ in the intermediate inflatable bladder 13*b*, and the predetermined test inflation pressure $P_{ip}$ in the intermediate inflatable bladder 13*b* can be greater than a predetermined test inflation pressure $P_{pp}$ in the proximal inflatable bladder 13*c*. Thus, setting 80 the one or more inflation parameters of the inflatable bladders 13*a*, 13*b*, 13*c* such that the pressure signals $P_d$, $P_i$, $P_p$ equal the respective predetermined test inflation pressures $P_{dp}$, $P_{ip}$, $P_{pp}$ results in a pressure gradient in which $P_d>P_i>P_p$ during a subsequent therapeutic compression cycle. The setting 80 of the one or more inflation parameters of the inflatable bladders 13*a*, 13*b*, 13*c* is similar to the adjustment described above.

While single values of predetermined test inflation pressures $P_{dp}$, $P_{ip}$, $P_{pp}$ have been described, the predetermined test inflation pressures $P_{dp}$, $P_{ip}$, $P_{pp}$ can additionally or alternatively include a respective predetermined pressure range and/or a respective predetermined pressure ratio based on expected test inflation pressures, given the test inflation time and the test inflation rate for a given inflatable bladder 13*a*, 13*b*, 13*c*. As compared to embodiments in which the comparison 60 of the pressure signals $P_d$, $P_i$, $P_p$ is made to single values of the predetermined test inflation pressures $P_{dp}$, $P_{ip}$, $P_{pp}$, the use of ranges and/or ratios of predetermined test inflation pressures $P_{dp}$, $P_{ip}$, $P_{dp}$ can, for example, reduce the number of adjustments needed to the inflation parameters while allowing adjustments in response to conditions likely to impact the therapeutic compression cycle of the compression garment 10.

Additionally or alternatively, the predetermined test inflation pressures $P_{dp}$, $P_{ip}$, $P_{pp}$ can be the previously measured test inflation pressures (e.g., measured during the previous test inflation cycle) for the respective inflatable bladder 13*a*, 13*b*, 13*c*. Basing the predetermined test inflation pressures $P_{dp}$, $P_{ip}$, $P_{pp}$ on previously measured test inflation pressure pressures can facilitate, for example, maintaining a customized pressure gradient in the inflatable bladders 13*a*, 13*b*, 13*c*.

It should be appreciated that, in certain embodiments, the computer readable storage medium 33 can include instructions to cause the one or more processors 7 to recognize the compression garment 10 connected to the controller 5 and access predetermined test inflation pressures $P_{dp}$, $P_{ip}$, $P_{pp}$ stored in the computer readable storage medium 33 associated with the recognized compression garment 10.

As yet another example, while the pressure signals $P_d$, $P_i$, $P_p$ have each been described as being a respective single pressure measurement during a test inflation cycle of a respective inflatable bladder 13*a*, 13*b*, 13*c*, other methods of determining pressure in the inflatable bladders 13*a*, 13*b*, 13*c* during the respective test inflation cycles are additionally or alternatively possible. For example, controlling 40 the test inflation cycle of each inflatable bladder 13*a*, 13*b*, 13*c* can include inflating each of the inflatable bladders 13*a*, 13*b*, 13*c* multiple times and receiving 50 the plurality of pressure signals $P_d$, $P_i$, $P_p$ from the pressure sensor 27 includes averaging the respective pressure signals $P_d$, $P_i$, $P_p$ for the multiple test inflation cycles of each respective inflatable bladder $\mathbf{13}_a$, $\mathbf{13}_b$, $\mathbf{13}_c$. Averaging the test inflation pressures $P_a$, $P_i$, $P_p$ can reduce the likelihood that setting 80 one or more inflation parameters of at least one of the inflatable bladders 13*a*, 13*b*, 13*c* would be based on a spurious measurement.

As still another example, while compression systems have been described as being used with thigh length compression sleeves, it should be understood that the compression systems can additionally or alternatively be used with other types of compression garments. For example, the compression systems can be used with knee-length compression sleeves and/or with sleeves having a different number of bladders configured to be disposed over different areas of the wearer's body.

Embodiments can be implemented in digital electronic circuitry, or in computer hardware, firmware, software, or in combinations thereof. The controller of the compression system can be implemented in a computer program product tangibly embodied or stored in a machine-readable storage device for execution by a programmable processor; and method actions can be performed by a programmable processor executing a program of instructions to perform functions of the controller of the compression system by operating on input data and generating output. The controller of the compression system can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD_ROM disks. Any of the foregoing can be supplemented by, or incorporated in, ASICs (application-specific integrated circuits) or FPGAs (field programmable logic arrays).

A number of embodiments have been described. Nevertheless, it will be understood that various modifications may be made without departing from the spirit and scope of the disclosure. For example, while a controller with a single pressure sensor has been described, additional pressure sensors (e.g., one for each inflatable bladder) can also be used without departing from the scope of the present disclosure. Accordingly, other embodiments are within the scope of the following claims.

What is claimed is:

1. A compression device controller comprising: one or more processors; computer executable instructions embodied on a computer readable storage medium, the computer executable instructions including instructions for causing the one or more processors to:

control a non-therapeutic test inflation cycle of fluid flow from a fluid source to each inflatable bladder of a plurality of inflatable bladders of a compression garment;

receive a plurality of pressure signals from at least one pressure sensor, each pressure signal indicative of a corresponding non-therapeutic test inflation pressure in the respective inflatable bladder during the non-therapeutic test inflation cycle;

vent each inflatable bladder to reduce the pressure in the inflatable bladder to atmospheric pressure or to a residual pressure prior to inflation of another inflatable bladder such that the test inflation cycles of each of the inflatable bladders do not overlap;

compare the received plurality of pressure signals to one or more reference pressure values;

based at least in part on the comparison of the plurality of pressure signals to the one or more reference pressure values, set one or more therapeutic inflation parameters of at least one of the plurality of inflatable bladders for a therapeutic compression treatment; and based at least in part on the set one or more therapeutic inflation parameters, inflate the plurality of inflatable bladders to a respective second inflation pressure greater than the corresponding non-therapeutic test inflation pressure of each inflatable bladder to impart the therapeutic compression treatment.

2. The compression device controller of claim 1, wherein the instructions to receive a plurality of pressure signals include instructions to rank corresponding inflatable bladders relative to one another and the instructions to set one or more therapeutic inflation parameters includes instructions to adjust the one or more therapeutic inflation parameters based at least in part on the rank of the corresponding inflatable bladders relative to one another.

3. The compression device controller of claim 2, wherein the instructions to set the one or more therapeutic inflation parameters include instructions to adjust the one or more therapeutic inflation parameters if the relative ranking of the plurality of inflatable bladders does not match a set ranking of the inflatable bladders.

4. The compression device controller of claim 1, wherein the instructions to set the one or more therapeutic inflation parameters include instructions to set the one or more therapeutic inflation parameters based on a predetermined pressure gradient of the respective second pressures of the plurality of inflatable bladders.

5. The compression device controller of claim 1, wherein the instructions to compare the received plurality of pressure signals to one or more reference pressure values include instructions to compare the received plurality of pressure signals to each other.

6. The compression device controller of claim 1, wherein the instructions to compare the received plurality of pressure signals to one or more reference pressure values include instructions to compare the received plurality of pressure signals to predetermined pressure values.

7. The compression device controller of claim 1, wherein the instructions to compare the received plurality of pressure signals to one or more reference pressure values include instructions to compare an average of a plurality of pressure signals of a respective inflatable bladder to one or more reference pressure values.

8. The compression device controller of claim 1, wherein the non-therapeutic test inflation pressure of each inflatable bladder is less than about 20 mmHg and the second inflation pressure of each inflatable bladder is greater than about 25 mmHg.

9. The compression device controller of claim 1, wherein the instructions to control the non-therapeutic test inflation cycle of fluid flow to each inflatable bladder include instructions to control one or more of a test inflation time and a test inflation flow rate to each respective inflatable bladder.

10. The compression device controller of claim 1, wherein the instructions to control the non-therapeutic test inflation cycle of fluid flow to each inflatable bladder include instructions to initiate the non-therapeutic test inflation cycle to each inflatable bladder at a specified interval.

11. The compression device controller of claim 1, wherein the computer readable storage medium further comprises instructions for causing the one or more processors to determine a vascular refill time associated with a limb of a subject, wherein the instructions to control the non-therapeutic test inflation cycle of fluid flow to each inflatable bladder are initiated based at least in part on a change in the vascular refill time associated with the limb of the subject.

12. The compression device controller of claim 1, wherein the instructions to control the non-therapeutic test inflation cycle of fluid flow to each inflatable bladder include instructions to inflate and deflate one inflatable bladder at a time.

13. The compression device controller of claim 1, wherein the instructions to control the non-therapeutic test inflation cycle of fluid flow to each inflatable bladder include instructions to inflate and deflate each inflatable bladder in sequence, one after another.

14. The compression device controller of claim 1, wherein each pressure signal is received generally at an end of the non-therapeutic test inflation cycle of the respective inflatable bladder.

15. A compression system comprising:

a compression garment including inflatable bladders;

valves actuatable to control fluid flow from a fluid source to the inflatable bladders;

at least one pressure sensor postionable, through actuation of the valves, in pneumatic communication with each inflatable bladder; and a controller in electrical communication with the at least one pressure sensor and the valves, the controller comprising one or more processors, a computer readable storage medium, and computer executable instructions embodied on the computer readable storage medium, the computer executable instructions including instructions for causing the one or more processors to:

control a non-therapeutic test inflation cycle of fluid flow from the fluid source to each inflatable bladder;

receive a plurality of pressure signals from the at least one pressure sensor, each pressure signal indicative of a corresponding non-therapeutic test inflation pressure in the respective inflatable bladder;

vent each inflatable bladder to reduce the pressure in the inflatable bladder to atmospheric pressure or to a residual pressure prior to inflation of another inflatable bladder such that the test inflation cycles of each of the inflatable bladders do not overlap;

compare the received plurality of pressure signals to one or more reference pressure values;

based at least in part on the comparison of the plurality of pressure signals to the one or more reference pressure values, set one or more therapeutic inflation parameters of at least one of the inflatable bladders for a therapeutic compression treatment; and based at least in part on the set one or more therapeutic inflation parameters, inflate the inflatable bladders to a respective second inflation pressure greater than the corresponding non-therapeutic test pressure of each inflatable bladder to impart the therapeutic compression treatment.

16. A computer-implemented method of controlling inflation of a compression garment, the computer-implemented method comprising:

controlling a non-therapeutic test inflation cycle of fluid flow from a fluid source to each inflatable bladder of a plurality of inflatable bladders;

receiving a plurality of pressure signals from at least one pressure sensor, each pressure signal indicative of a corresponding non-therapeutic test inflation pressure in the respective inflatable bladder;

venting each inflatable bladder to reduce the pressure in the inflatable bladder to atmospheric pressure or to a residual pressure prior to inflation of another inflatable bladder such that the test inflation cycles of each of the inflatable bladders do not overlap;

comparing the received plurality of pressure signals to one or more reference pressure values;

based at least in part on the comparison of the plurality of pressure signals to the one or more reference pressure values, setting one or more therapeutic inflation parameters of at least one of the plurality of inflatable bladders for a therapeutic compression treatment; and based at least in part on the set one or more therapeutic inflation parameters, inflating the plurality of inflatable bladders to a respective second inflation pressure greater than the corresponding non-therapeutic test pressure of each inflatable bladder to impart the therapeutic compression treatment.

17. The computer-implemented method of claim 16, wherein comparing the received plurality of pressure signals to one or more reference pressure values includes comparing the received plurality of pressure signals to each other.

18. The computer-implemented method of claim 17, wherein comparing the received plurality of pressure signals to one or more reference pressure values includes comparing the received plurality pressure signals to predetermined pressure values.

19. The computer-implemented method of claim 16, wherein comparing the received plurality of pressure signals to one or more reference pressure values includes ranking corresponding inflatable bladders relative to one another and setting the one or more inflation parameters includes adjusting the one or more inflation parameters based at least in part on the rank of the corresponding inflatable bladders relative to one another.

20. The computer-implemented method of claim 16, wherein the non-therapeutic test inflation pressure of each bladder is less than about 20 mmHg and the second inflation pressure of each inflatable bladder is greater than about 25 mmHg.

* * * * *